US010896793B2

(12) United States Patent
Mezoe

(10) Patent No.: US 10,896,793 B2
(45) Date of Patent: Jan. 19, 2021

(54) UNIQUE COVER FOR LIGHT SWITCH TOGGLE

(71) Applicant: Lawrence Mezoe, Keller, TX (US)

(72) Inventor: Lawrence Mezoe, Keller, TX (US)

( * ) Notice: Subject to any disclaimer, the term of this patent is extended or adjusted under 35 U.S.C. 154(b) by 0 days.

(21) Appl. No.: 16/181,025

(22) Filed: Nov. 5, 2018

(65) Prior Publication Data

US 2019/0139726 A1 May 9, 2019

Related U.S. Application Data

(60) Provisional application No. 62/581,753, filed on Nov. 5, 2017.

(51) Int. Cl.
*H01H 23/04* (2006.01)
*H01H 23/14* (2006.01)

(52) U.S. Cl.
CPC ..... *H01H 23/04* (2013.01); *H01H 23/14* (2013.01); *H01H 23/141* (2013.01)

(58) Field of Classification Search
CPC .... H01H 23/14; H01H 23/141; H01H 23/143; H01H 23/146; H01H 23/148
See application file for complete search history.

(56) References Cited

U.S. PATENT DOCUMENTS 3,581,037 A * 5/1971 Schiffelbein ..... H01H 23/141 200/331
8,253,049 B2 * 8/2012 Grisby ..... H01H 23/141 200/330

* cited by examiner

*Primary Examiner* — Vanessa Girardi

(57) ABSTRACT

A toggle cover apparatus is used to alter the outer appearance of a light switch toggle by attaching an object to the toggle. The object has a hole with a seal attached inside of it. The seal has a hole that fits on the toggle and keeps the object attached. The object is then used to activate the switch.

7 Claims, 6 Drawing Sheets

UNIQUE COVER FOR LIGHT SWITCH TOGGLE

BACKGROUND

1. Field of the Invention

The present invention relates generally to lighting systems, and more specifically, to a toggle cover apparatus for personalizing the interface of a light switch.

2. Description of Related Art

Lighting systems are well known in the art and are effective means to illuminate spaces or areas. For example, FIG. 1 depicts a conventional light switch device 101 having a face plate 103 mounted to a wall 105, with a light switch actuator 107 pivotally attached thereto. During use, the light switch actuator 107 is moved from one position to a next to active or deactivate a light 109.

One of the problems commonly associated with device 101 is its limited use. For example, many spaces particularly rooms in houses are altered to reflect the personality or taste of the occupant, owner or designer, while many methods of altering the face place 103 are available it is more difficult to alter the toggle and so it remains in the same state as manufactured.

Additionally, when non-standard toggles are made they are limited and do not conform to the theme, colors or appearance of the room they are found in further limiting the use of the toggle.

Accordingly, although great strides have been made in the area of light switch devices 101, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
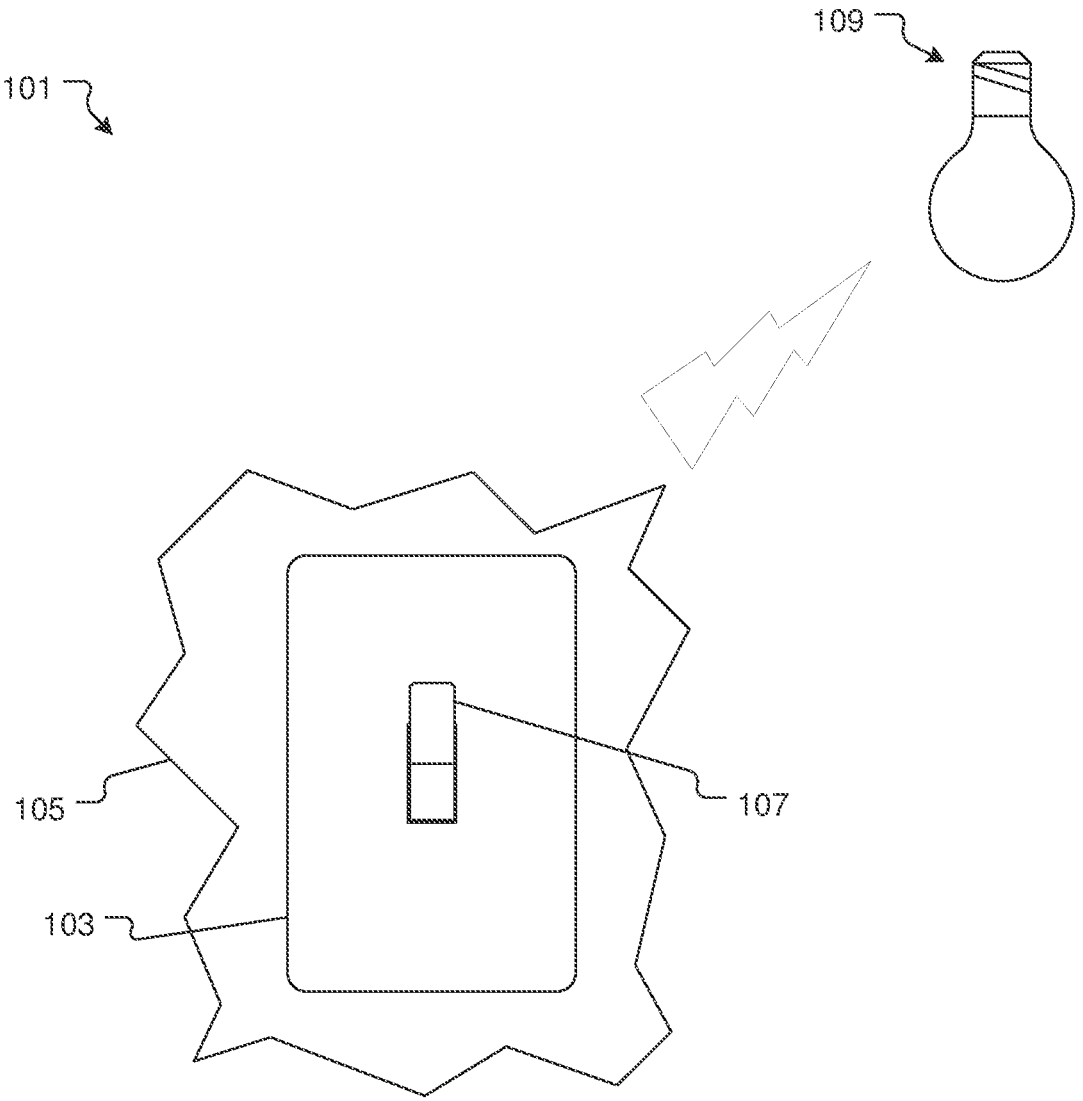
FIG. 1 (Prior Art)
FIG. 1 is a front view of a common light switch device.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional light switch devices. Specifically, the devices of the present application enables the alteration of the light switch actuator, which can include, among others, a bi-stable toggle and a dimmer switch shaft, to conform to the room where it is located. In addition the apparatus enables a user to create a custom apparatus allowing for many variations to suit the room where the light switch actuator is located. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 2A:
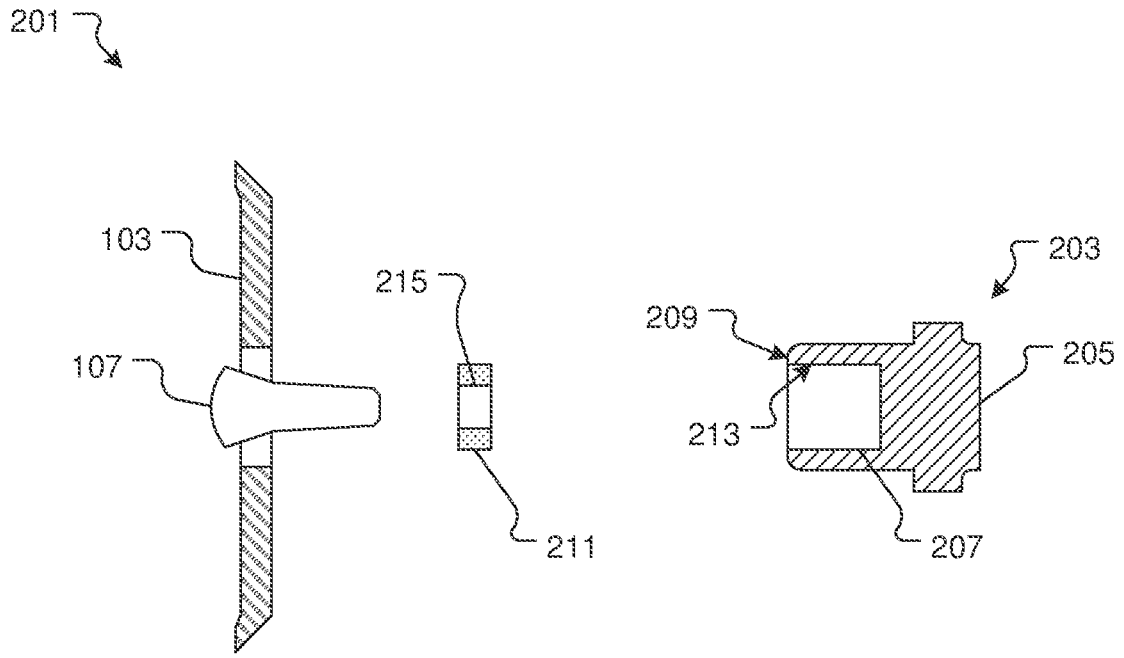
FIGS. 2A and 2B are cross-sectional side views of a light switch actuator cover device in accordance with a preferred embodiment of the present application before and after assembly.
Figure 2B:
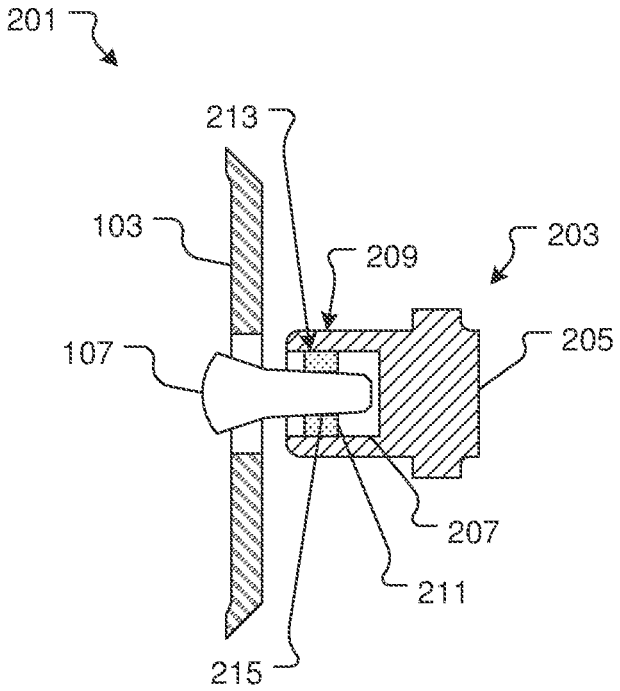

Referring now to the drawings wherein like reference characters identify corresponding or similar elements throughout the several views, FIGS. 2A and 2B depict cross-sectional side views of a light switch actuator cover device in accordance with a preferred embodiment of the present application. It will be appreciated that system 201 overcomes one of more of the above-listed problems commonly associated with conventional light switch devices.

In the contemplated embodiment, system 201 includes an outer cover 203 having a body 205 with a pocket 207 extending inward from an outer surface 209. A pliable seal 211 is attached to the inside surface 213 of the pocket 207. The pliable seal 211 having a hole 215 passing through the width thereof. The hole 215 of the seal 211 being configured to temporarily attach to a light switch actuator 107 of a light switch device 101 via friction and constriction of the seal 211.

In use, the outer cover 203 is placed on the light switch actuator 107 so that the toggle light switch actuator 107 enters the pliable seal 211 and affixes thereto. The outer cover 203 is then used to move the light switch actuator 107 from one position to another to activate or deactivate the light switch device 101.

It should be appreciated that one of the unique features believed characteristic of the present application is the simplicity of attaching the outer cover 203 to the light switch actuator 107 via the pliable seal 211. It will be appreciated that any object that has a pocket 207 could be used as the outer cover 203.

Figure 3:
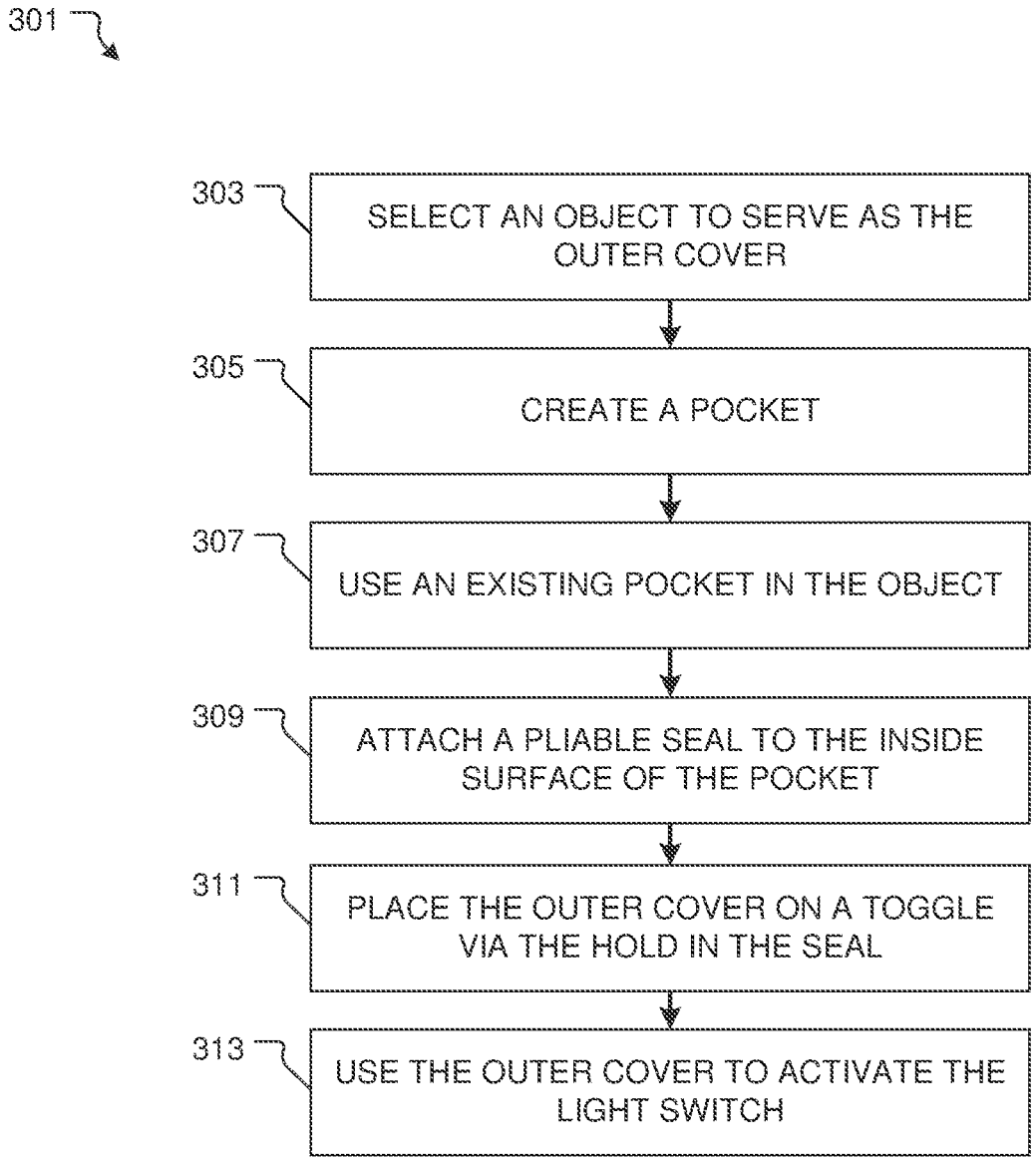
FIG. 3 is a flowchart of the preferred method of use of the device of FIGS. 2A and 2B.

Referring now to FIG. 3 the preferred method of use of the apparatus 201 is depicted. Method 301 including selecting an object to serve as the outer cover 303, creating a pocket in the outer cover or using an existing pocket 305, 307, attaching a pliable seal to the inside surface of the pocket 309, placing the outer cover on a light switch actuator via the hole of the pliable seal 311 and using the outer cover to move the light switch actuator from one position to another to activate a light 313.

Figure 4:
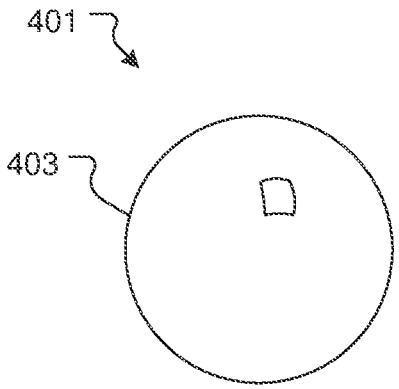
FIGS. 4, 5 and 6 are perspective views of alternative embodiments of the cover of FIGS. 2A and 2B.
Figure 5:
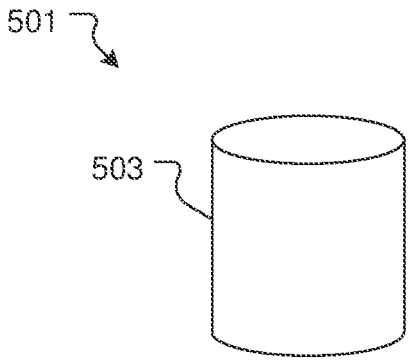
Figure 6:
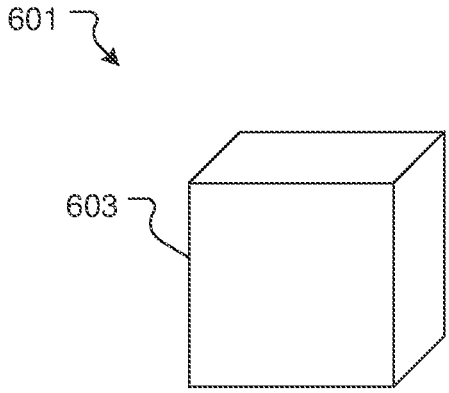

Another unique feature believed characteristic of the present application is that pocket 207 can be made in an object where one does not exist. Referring now to FIGS. 4, 5 and 6 various embodiments of outer cover 203 are depicted. Embodiment 401 including a baseball having a spherical outer cover 403. Embodiment 501 including a wine cork having a cylindrical outer cover 503 and embodiment 601 including a dice having a cubed outer cover 601. It will be appreciated that each has a pocket wherein a pliable seal is attached.

Figure 7:
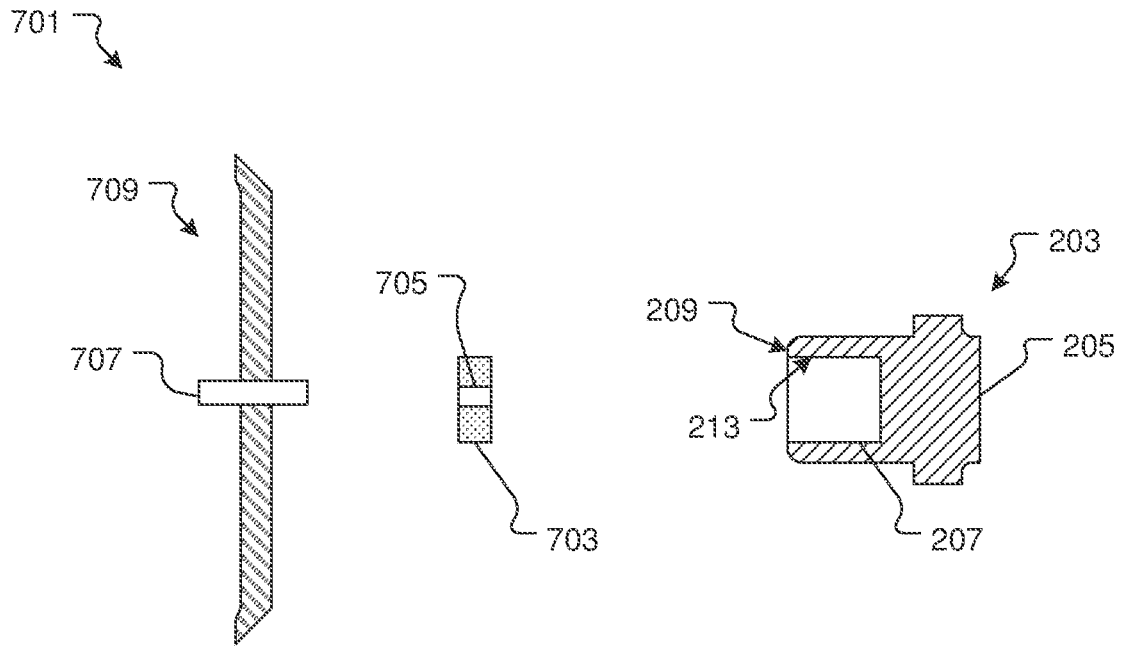
FIG. 7 is a cross-sectional side view of an alternative embodiment of the device of FIGS. 2A and 2B.
Figure 8:
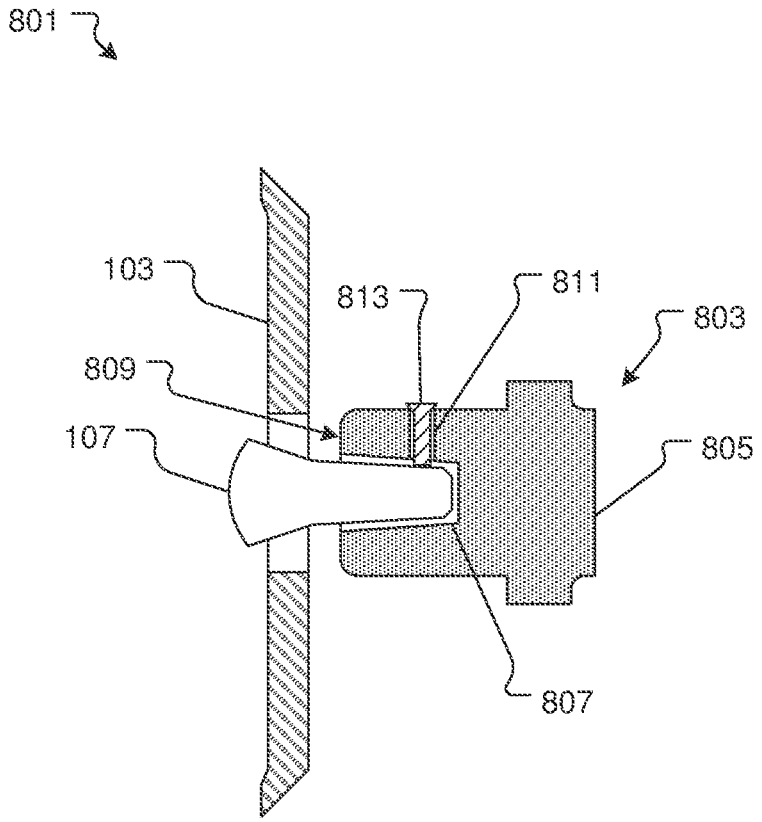
FIG. 8 is a cross-sectional side view of an alterntive embodiment of the apparatus of FIGS. 2A and 2B.

Referring now to FIG. 7 an alternative embodiment of apparatus 201 is depicted. Embodiment 701 including an outer cover 203 having a body 205 with a pocket 207 extending inward from an outer surface 209. A pliable seal 703 is attached to the inside surface 213 of the pocket 207. The pliable seal 703 having a hole 705 passing through the width thereof. The hole 705 of the seal 703 having a diameter smaller that the shaft 707 of a dimmer switch 709. The hole 705 being configured to temporarily attach to the shaft 707 of the dimmer switch 101 via friction and constriction of the 705.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed:

1. A light switch cover device configured to removably engage with a light switch actuator; the light switch cover comprising at least two distinct components;

one component is a substantially rigid body that forms a pocket, the body having an outer surface, the pocket extending inwardly from the outer surface, the pocket is shaped to receive the light switch actuator therein;

a second component is a pliable seal attached to an inside surface of the pocket; the pliable seal having a hole passing therethrough; the hole of the seal permits removable attachment of the light switch cover to the light switch actuator via friction and elasticity of the seal such that the seal forms a snug fit between the body and the light switch actuator thus retaining the light switch cover to the light switch actuator.

2. The device of claim 1; wherein the light switch actuator is a bi-stable toggle.

3. The device of claim 1; wherein the light switch actuator is a dimmer switch shaft.

4. The device of claim 1 further comprising;

a penetration passing through the body; and a threaded fastener configured to extend into the penetration and engage with the light switch actuator further securing the light switch cover to the light switch actuator.

5. The device of claim 1 wherein the outer surface is a spherical body.

6. The device of claim 1 wherein the outer surface is a cylindrical body.

7. The device of claim 1 wherein the outer surface is a cubed body.

* * * * *